US005732605A

United States Patent [19]

Mann

[11] Patent Number: 5,732,605

[45] Date of Patent: Mar. 31, 1998

[54] WRENCH EXTENSION TOOL

[76] Inventor: Dennis L. Mann, 2239 N. Broad St., Colmar, Pa. 18915

[21] Appl. No.: 819,302

[22] Filed: Mar. 18, 1997

Related U.S. Application Data

[63] Continuation of Ser. No. 531,093, Sep. 20, 1995, abandoned.

[51] Int. Cl.[6] ..... B25B 17/00

[52] U.S. Cl. ..... 81/57.3; 81/185; 81/DIG. 11

[58] Field of Search ..... 81/57.3, 57.14, 81/185, 124.4, 125, DIG. 11

[56] References Cited

U.S. PATENT DOCUMENTS

| | | | |
|---|---|---|---|
| 562,689 | 6/1896 | Willows | 81/185 |
| 1,350,315 | 8/1920 | Katzmarek | 81/125 X |
| 1,635,102 | 7/1927 | Watson | 81/125 |
| 2,322,856 | 6/1943 | Le Roue | 81/185 |
| 2,830,479 | 4/1958 | Finn | 81/57.3 |
| 4,063,475 | 12/1977 | Perkins | 81/57.22 |
| 4,817,475 | 4/1989 | Kelly et al. | 81/124.4 X |
| 4,867,016 | 9/1989 | Di Edwardo | 81/57.3 |
| 5,355,751 | 10/1994 | Specht | 81/57.3 X |

FOREIGN PATENT DOCUMENTS

| | | | |
|---|---|---|---|
| 2056348 | 3/1981 | United Kingdom | 81/57.3 |

*Primary Examiner*—D. S. Meislin

*Attorney, Agent, or Firm*—Eugene E. Renz, Jr., P.C.

[57] ABSTRACT

A wrench extension tool having a gear train of intermeshing idler gears contained within an inner housing formed of two (2) curved and substantially parallel plates. Aligned pairs of bores are provided through the parallel plates providing residence for axle pins about which the idler gears rotate. At each end of the wrench extension tool is a socket opening in which there resides an end gear. Each end gear includes a journal portion extending therefrom with the socket opening serving as bearings for such journals. Each end gear includes a hexagonal socket receptacle into which interchangeable driven and drive sockets can be inserted by a user. A locking mechanism is provided to retain the chosen drive and driven sockets in the socket receptacles. In such manner, a relatively narrow wrench extension tool is provided where either end of the wrench extension tool can serve as the driven end and either end can serve as the drive end.

1 Claim, 6 Drawing Sheets

WRENCH EXTENSION TOOL

This is a continuation of application Ser. No. 08/531,093 filed on Sep. 20, 1995 now abandoned.

BACKGROUND OF THE INVENTION

1. Field of the Invention

The present invention relates generally to tools such as wrenches for applying torque to nuts, bolts, screws and the like and, more particularly, to an extension for such tools allowing torque to be applied to nuts, bolts, screws and the like in places generally inaccessible to such tools.

2. Brief Description of the Prior Art

A variety of extension tools to be used in combination with the wrenches are known in the prior art. One such extension tool is taught in U.S. Pat. No. 4,374,480 to Diaz. Diaz teaches an extension wrench for transmitting torque to a fastener with a restricted access. The extension wrench includes an elongated frame having a driven gear at one end and a driving gear at the opposite end. There is a meshing gear train between the driving gear and the driven gear. There are holes in the driving and driven gears which are designed to accept the standard conventional socket set drivers, extension shafts, wrenches and screwdrivers. The gears are supported without shafts in close fitting circular recesses in the elongated frame.

U.S. Pat. No. 4,649,776 to Puncochar teaches a torque transmitting extension wrench assembly comprising a plurality of intermeshing gears in series positioned between a first tool gear and a second tool gear in housing. The first tool gear is adapted to receive conventional socket set drivers and the second tool gear is adapted to receive conventional sockets. Each of the intermediate or idler gears includes a coraxial shaft about which it is rotatable.

U.S. Pat. No. 2,482,387 to Veneman teaches a gear operated double-socket wrench wherein there is a gear train contained within a frame. At one end of the frame is a drive gear adapted to be used in conjunction with a hexagonal extension attached thereto. In such manner, a power drill having a socket mounted therein can be fit over the hexagonal extension to cause the drive gear to rotate. Rotational movement is transmitted through the gear train to two (2) driven gears which rotate in opposite directions. Each of the driven gears have sockets formed therein in which removable adapter sockets can be placed to fit various size nuts and bolts. The adapter sockets extend only slightly beyond the housing of the wrench. There is no apparent way to lock the adapter sockets into the wrench.

U.S. Pat. No. 2,860,479 to Finn teaches yet another gear operated wrench. The hubs of the end gears of the gear train are adapted to receive and removably hold shank portions of either a driving tool or a driven tool.

U.S. Pat. No. 3,987,691 to Savage teaches still another extensible wrench for use in close quarters comprising an intermeshing gear train contained within a frame. At each end of the gear train is an enlarged head housing a rotatable socket. In one socket them may be inserted the driver of, for example, an air driven wrench. In the opposite socket if there may be inserted an adapter nut socket for use with nuts and bolts.

SUMMARY OF THE INVENTION

It is an object of the present invention to provide a wrench extension tool wherein interchangeable sockets may be used to drive various size nuts and bolts and wherein the insertion of such interchangeable sockets into the tool does not add to the overall dimensions of the tool.

It is a further object of the present invention to provide a wrench extension tool wherein the interchangeable socket in use is contained substantially within the frame or housing of the tool and is locked into the frame or housing of the tool regardless of orientation of the frame.

Another object of the present invention is to provide a wrench extension tool having a socket opening in end gears at each end of the tool wherein either of the end gears may be used as the drive gear or the driven gear.

Another object of the present invention is to provide a wrench extension tool including a gear train contained within a frame or housing having socket openings at each end thereof wherein all of the openings in said frame are substantially sealed with the exception of the socket openings.

Briefly stated, these and numerous other features, objects and advantages of the present invention will become readily apparent upon reading of the detailed description, claims and the drawings set forth herein. These objects, features and advantages are accomplished with a housing comprising two (2) curved side plates that are used to align the gear train and provide rigidity to the assembly. At each end of the gear train is an end gear having a socket receptacle therein for a receipt of interchangeable sockets. Each of the interchangeable sockets has an annular lip at one end thereof which prevents the interchangeable sockets from passing completely through the socket receptacles in the end gears. Means are provided for engaging the annular lip to thereby lock the interchangeable socket into the socket receptacles and prevent the interchangeable socket from falling out of the socket opening regardless of orientation of the extension tool. Each of the curved plates forming the inner housing have a plurality of bores therethrough providing residence for a series of axle pins press fit therein. Each of the axle pins includes an enlarged shaft portion terminating at an annular shoulder. The annular shoulders of the enlarged shaft portions provide a pre-determined spacing between the two (2) curved plates. Rotatably supported about the enlarged shaft portions of the axle pins are the individual gears which form the gear train. At each end of each side plate is a large circular opening that acts as an outer bearing surface for the end gears. Each of the end gears includes a journal projecting from each side thereof residing in the circular openings. An external housing is provided which covers the bores which provide residence for the axle pin. In addition, end caps are provided to substantially seal the area between the two (2) curved plates at the ends of the wrench extension tool. In such manner, the gear train is substantially sealed from the environment and can be permanently lubricated during manufacture.

Interchangeable sockets can be inserted into both ends of the wrench extension tool of the present invention with either end serving as the drive end and the other serving as the driven end. In addition, a variety of different size sockets, either standard or metric, can be inserted into either end depending on the size of the nut or bolt to be driven with. The socket inserted will not extend beyond the external housing. In such manner, a wrench extension tool is provided which can reach into spaces not otherwise accessible to ordinary hand or powered wrenches or extensions. Further, because means are provided to retain the sockets in the socket receptacles of the wrench, the wrench can be inserted into hard to reach places without fear a socket falling therefrom.

DETAILED DESCRIPTION OF THE PREFERRED EMBODIMENT

Figure 2:
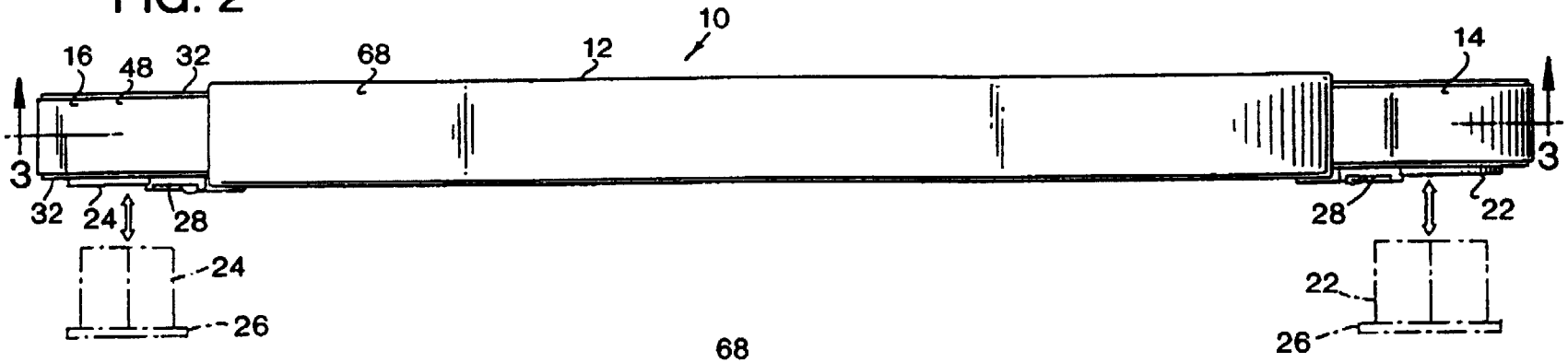
FIG. 2 is a top plan view of the wrench extension tool depicted in FIG. 1.
Figure 1:
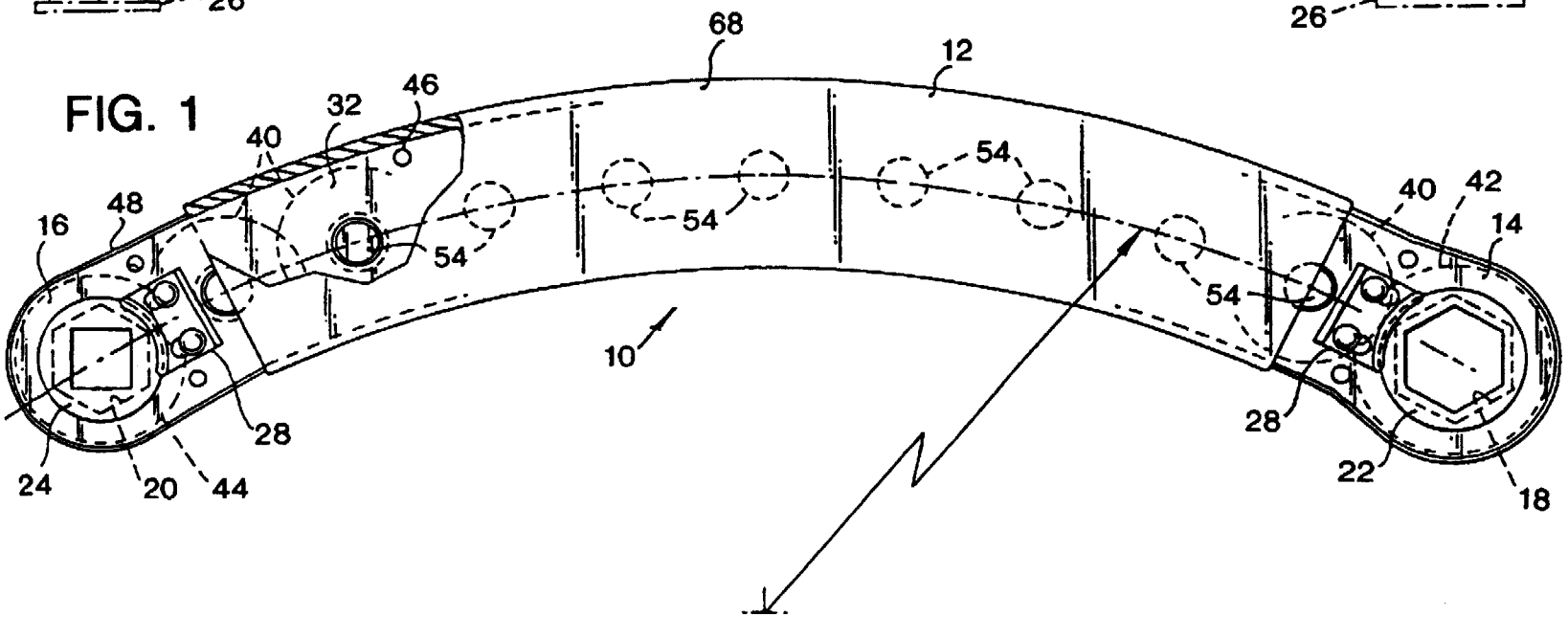
FIG. 1 is a side elevation of the wrench extension tool of the present invention shown in a curved configuration.
Figure 3:
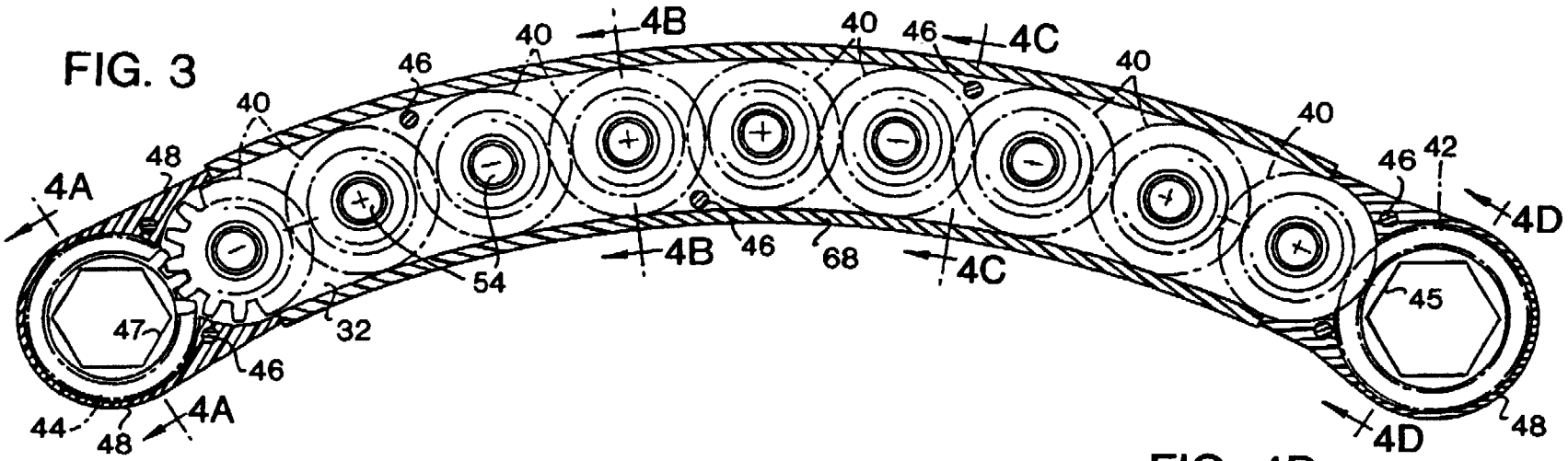
FIG. 3 is a cross sectional view of the wrench extension tool of the present invention taken along the lines 3—3 of FIG. 2.
Figure 4D:
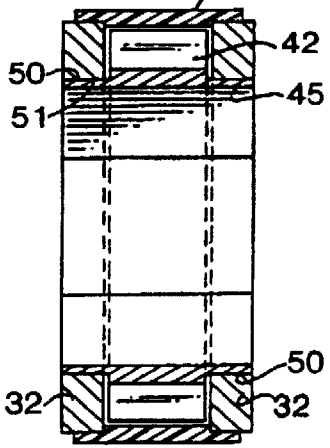
FIG. 4D is an enlarged transverse sectional view taken along the line 4D—4D of FIG. 3 showing details of assembly at the major receptacle end of the wrench.
Figure 4C:
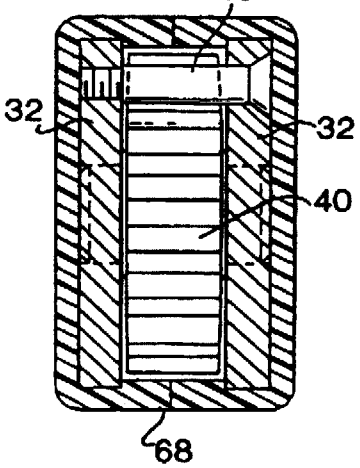
FIG. 4C is an enlarged transverse sectional view taken along the line 4C—4C of FIG. 3 showing details of assembly through side plate retaining means.
Figure 4B:
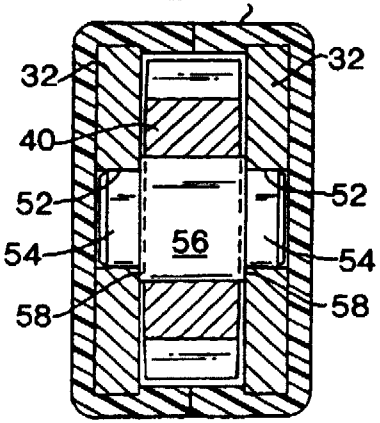
FIG. 4B is an enlarged transverse sectional view taken along the lines 4B—4B of FIG. 3 showing details of assembly through one of the intermeshing idler gears.
Figure 4A:
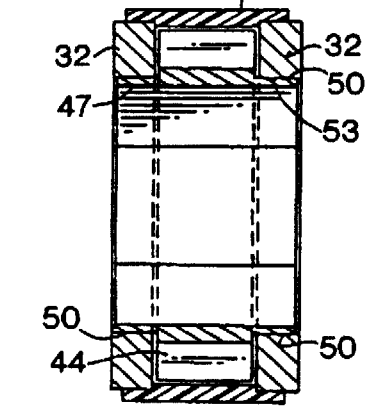
FIG. 4A is an enlarged transverse sectional view taken along the lines 4A—4A of FIG. 3 showing details of assembly at the minor receptacle end of the wrench.
Figure 5:
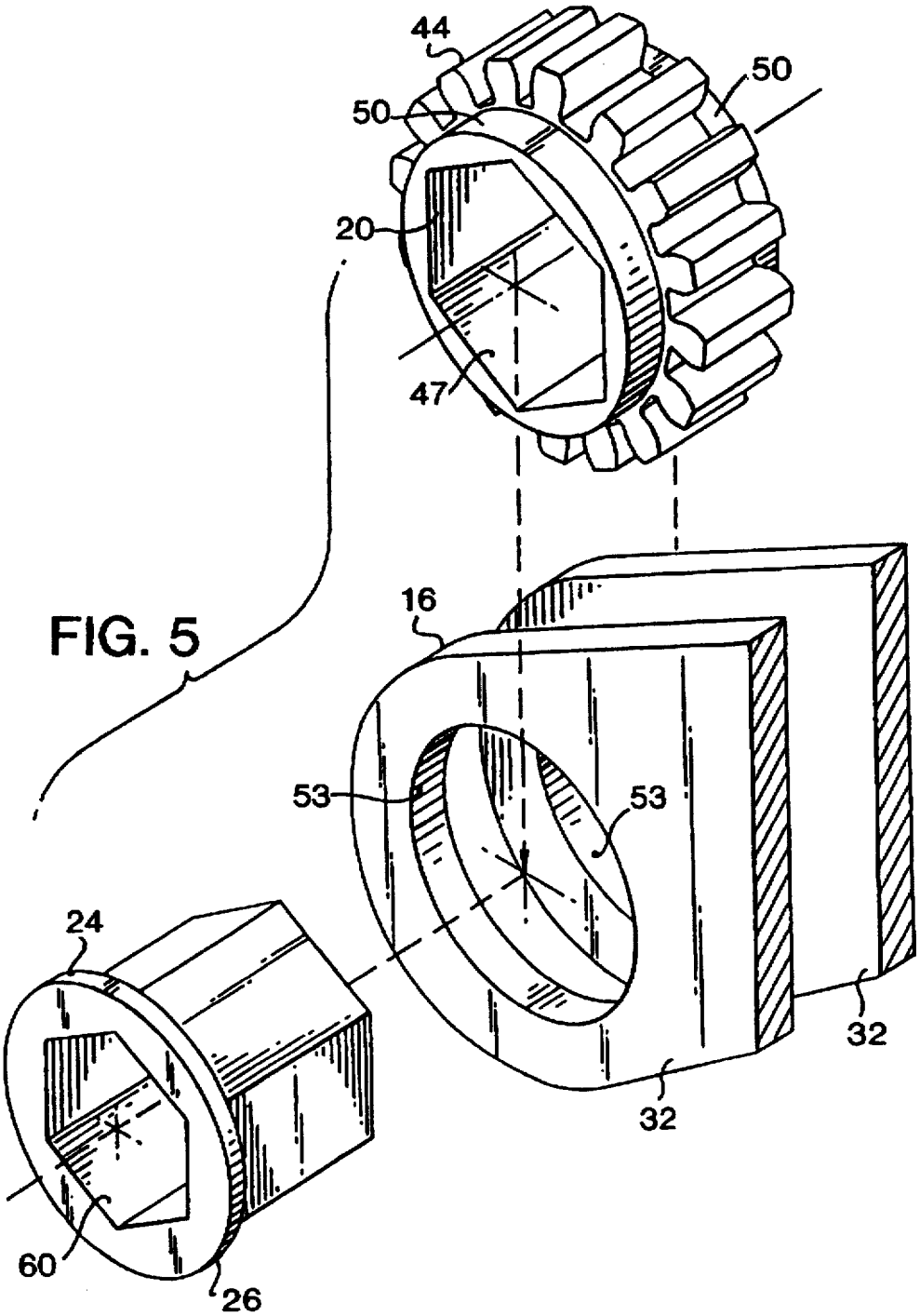
FIG. 5 is an enlarged fragmentary exploded isometric view of the minor receptacle end portion of the wrench extension tool of the present invention.
Figure 7:
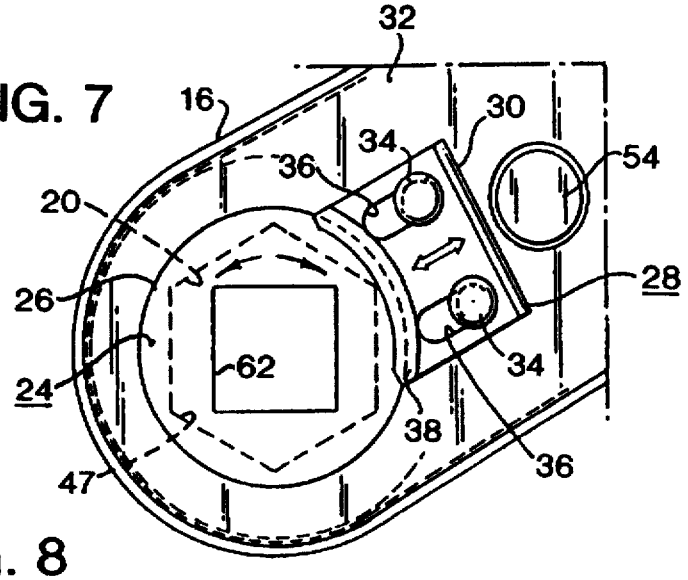
FIG. 7 is an enlarged fragmentary side elevational view of the minor receptacle end of the wrench showing details of the socket retaining means.

Turning first to FIG. 1, there is shown a side elevational view of the wrench extension tool (10) of the present invention. The wrench extension tool (10) is preferably arcuate in shape as shown but can be straight as well. The wrench extension tool (10) includes a handle portion (12) with a major socket receptacle end (14) at one end and a minor socket receptacle end (16) at the opposite end. There is a socket opening (18) in major socket receptacle end (14) and a socket opening (20) in minor socket end (16). As depicted in FIG. 1, there is an interchangeable driven socket (22) residing in socket opening (18) and an interchangeable drive socket (24) residing in socket opening (20). As shown more clearly in FIG. 2, interchangeable drive sockets (22) and driven sockets (24), reside substantially within the socket openings (18), (20). Each of the interchangeable driven sockets (22) and drive sockets (24) include an annular lip portion (26). Annular lip (26) prevents the interchangeable sockets (22), (24) from passing completely through socket openings (18), (20). In addition, in conjunction with slide mechanism (28), a means is provided for engaging annular lip (26) such that interchangeable sockets (22), (24) will not fall out of socket openings (18), (20) regardless of orientation of the wrench extension tool of the present invention. As shown in FIG. 7, the slide mechanism (28) includes a sled (30) slidably mounted to plate (32) by means of pins (34) through slots (36). Extending from sled (30) is arcuate shelf (38). When sled (30) is pushed toward one of the respective interchangeable driven and drive sockets (22), (24), arcuate shelf (38) engages over annular lip (26) thereby locking the driven and drive sockets (22), (24) in socket openings (18), (20).

Looking next at FIG. 3 and 4A through 4D, it can be seen that the wrench extension tool (10) of the present invention includes a gear train comprising a plurality of intermeshing idler gears (40). At one end of the gear train is major end gear (42) and at the opposite end of the gear train is minor end gear (44). Major and minor end gears (42), (44) can each serve as the drive gear or the driven gear. Major end gear (42) includes a hexagonal socket receptacle (45). Minor end gear (44) includes a hexagonal socket receptacle (47). Major and minor end gears (42), (44) reside in an internal housing comprised of plates (32). Plates (32) are preferably steel and are held in substantially parallel relationship by means of a series of machine screws (46). Residing between plates (32) is an end cap (48). Each end cap (48) is preferably an injection molded plastic part and includes a cylindrical opening providing residence for either the major end gear (42) or the minor end gear (44). The major end gear (42) and the minor end gear (44) each include a gear tooth surface there about with a journal portion (50) extending from each side thereof. Journal portions (50) reside in circular apertures (51), (53) which serve as bearings for journal portions (50).

There are a plurality of aligned bores (52) through plates (32). An axle pin (54) resides in each aligned pair of bores (52). Axle pins (54) are press fit into the aligned bores (52) such that there is created a substantial sealed relationship. Each axle pin (54) includes an enlarged shaft portion (56) thereby creating two (2) annular shoulders (58). Annular shoulders (58) insure the proper spacing between plates (32). Rotably mounted about each enlarged shaft (56) is one intermeshing idler gear (40). Because the axial length of each enlarged shaft (56) is greater than the width of each idler gear (40), and the idler gear (40) has slightly tapered faces, a proper spacing between each idler gear (40) and plates (32) is insured. In such manner, the tightening of machine screws (46) will not cause plates (32) to bind against the idler gears (40). The dimension between plates (32) is set by the axial length of the enlarged shaft portions (56). It should be recognized that only the intermeshing idler gears (40) rotate and not the axle pins (54).

Figure 6:
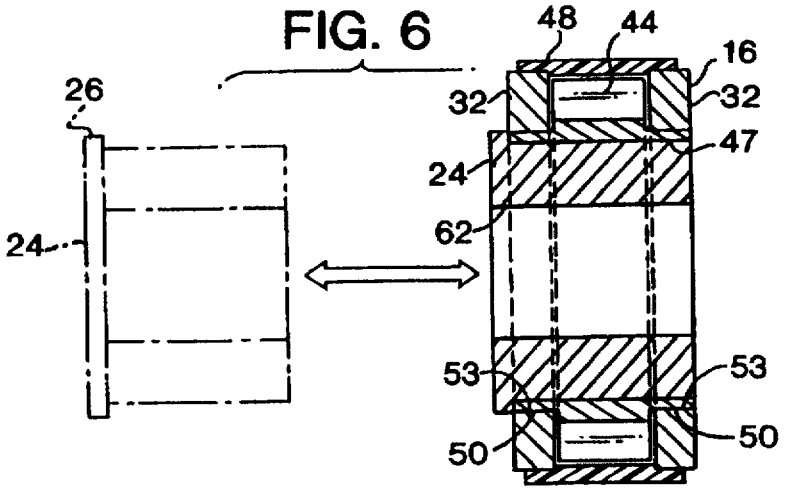
FIG. 6 is a transverse sectional view similar to FIG. 4A at the minor receptacle end of the wrench and showing one (1) of the set of interchangeable sockets inserted into the minor end gear socket receptacle.
Figure 8:
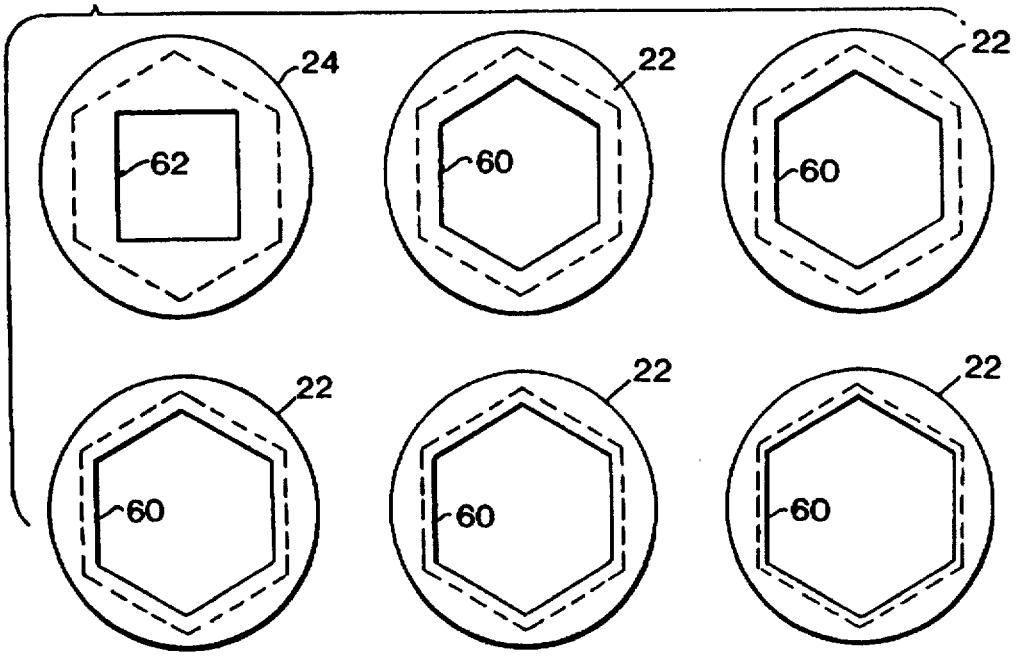
FIG. 8 is a top plan view of six (6) different interchangeable sockets having hexagonal openings of different sizes for insertion in the minor receptacle end of the wrench.

Looking next at FIGS. 6 through 8, there is shown in enlarged detail the minor socket receptacle end (16) and examples of the various size and type of interchangeable sockets to be used in conjunction therewith. Specifically, with reference to FIG. 8, it will be seen interchangeable driven sockets (22) having various hexagonally sized openings (60) therein which can be inserted into hexagonal socket receptacle (47). In addition, an interchangeable drive socket (24) with a square or box opening (62) may be inserted into hexagonal socket opening (47).

Figure 9:
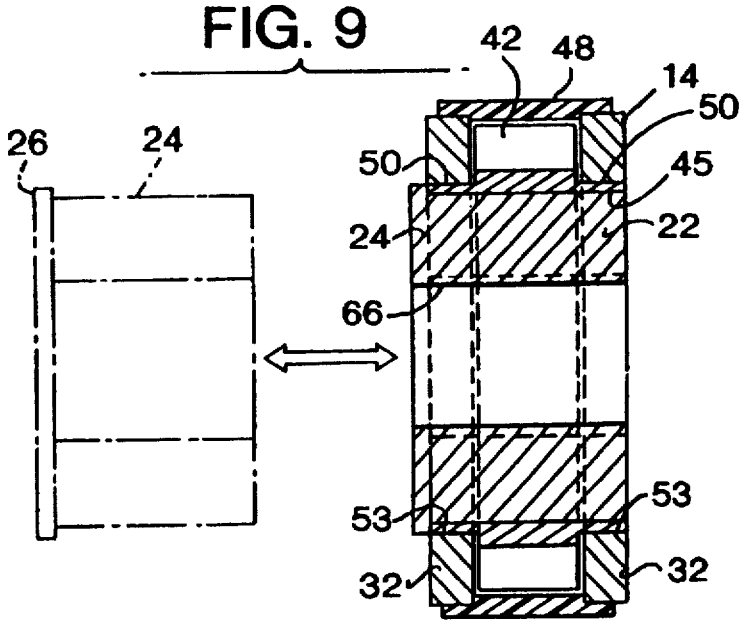
FIG. 9 is a transverse sectional view similar to FIG. 4D including one (1) of the interchangeable sockets inserted into the major end gear receptacle.
Figure 10:
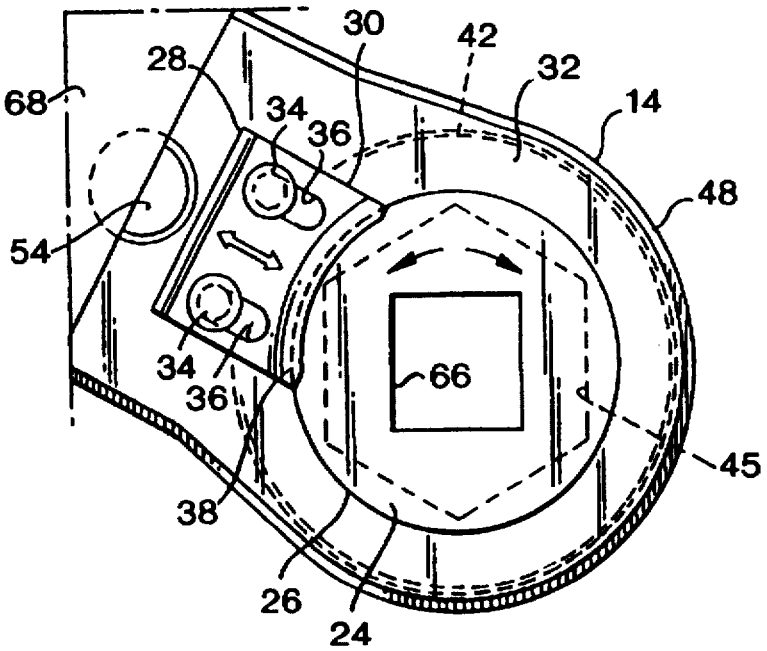
FIG. 10 is an enlarged fragmentary side elevational view of the major end of the wrench extension tool of the present invention with a driver socket inserted therein.
Figure 11:
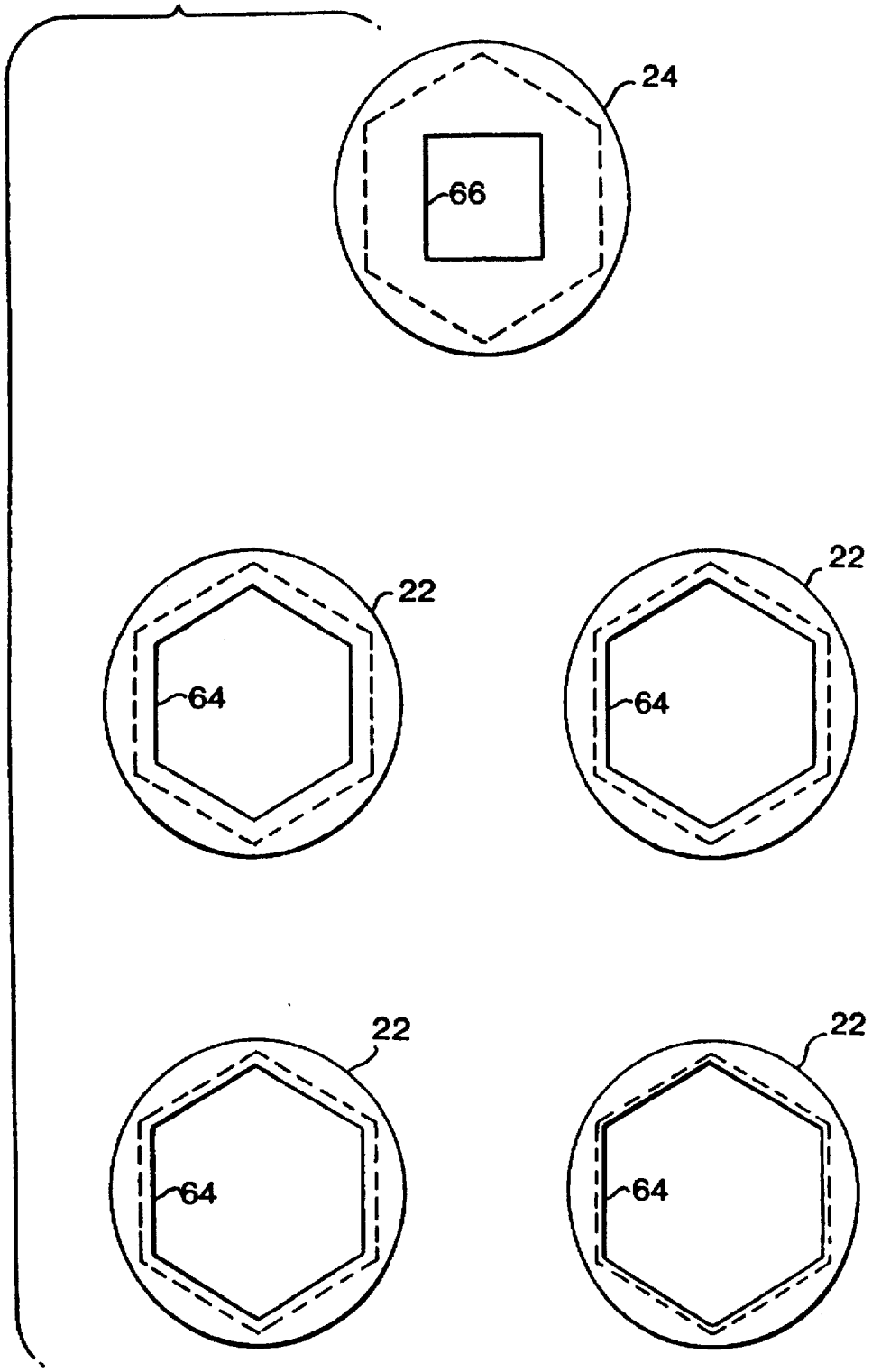
FIG. 11 is a top plan view of various interchangeable sockets for insertion at the major end of the wrench of the present invention.

Turning next to FIGS. 9 through 11, there is shown within enlarged detail the major socket receptacle end (14) of the wrench extension tool of (10) of the present invention. Socket receptacle (45) of the major socket receptacle end (14) can also receive a variety of interchangeable driven sockets (22) having various sized hexagonal openings (64) therein as well as a drive socket (24) having a box opening (66) therein.

Although major socket receptacle end (14) and minor socket receptacle end (16) are substantially similar to one another and the present invention can be practiced with the major and minor receptacle ends (14), (16) being substantially identical to one another, it may be advantageous to have one end sized to receive standard nuts and bolts while the opposite end is sized to receive metric sized nuts and bolts. In such manner, a wrench extension tool (10) is provided with great versatility in that it will handle both metric and standard size nuts and bolts while allowing either end of the tool (10) to be the driven end and the opposite end being the drive end.

There is a thermoformed or vacuum formed plastic sheath (68) encircling handle portion (12). Plastic sheath (68) serves as an external housing for purposes of comfort in gripping the tool (10) while additionally serving to help seal the internal gear train from contamination.

It will be appreciated by those skilled at the art that there is significant advantage in having interchangeable sockets in a relatively flat wrench where the sockets do not project beyond the width of the overall tool. This allows the wrench extension tool (10) of the present invention to be fit into relatively narrow spaces where typical prior art wrenches could not be placed. In addition, the wrench extension tool (10) provides for the insertion of the tool (10) into narrow places at any orientation without fear that the interchangeable driven and drive sockets (22), (24) will fall from the tool (10).

From the foregoing, it will be seen that this invention is one well adapted to attain all of the ends and objects hereinabove set forth together with other advantages which are apparent and which are inherent to the invention.

It will be understood that certain features and to sub-combinations are of utility and may be employed with reference to other features and sub-combinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

What is claimed is:

1. A wrench extension tool comprising:

(a) an internal housing comprising two curved side plates;

(b) an opening through each end of said internal housing;

(c) a plurality of intermeshing gears forming an intermeshing idler gear train located in said internal housing with an end gear positioned adjacent each of said openings, each of said end gears having a socket receptacle therein;

(d) a plurality of interchangeable sockets, each capable of residing in said socket receptacles, each of said interchangeable sockets having an annular lip larger than the diameter of said socket receptacles;

(e) means for engaging said annular lip to thereby retain said interchangeable sockets in said socket receptacles comprising;

(f) a slide mechanism including a sled mounted on the face of one side plate and movable linearly relative to a socket between inner and outer positions and having an arcuate shelf adapted to overlie the lip of a socket in the inner position to hold the socket in place and displaceable linearly to an outer position to permit removal of a socket, a central longitudinal axis extending along said internal housing to each end of said housing, pins attached to said housing along a line extending perpendicular to said central longitudinal axis, said sled containing at least two slots slidable on said pins to permit said linear movement.

* * * * *